US005321907A

United States Patent [19]

Ueno et al.

[11] Patent Number: 5,321,907

[45] Date of Patent: Jun. 21, 1994

[54] METHOD AND APPARATUS FOR STORING HORTICULTURAL PLANTS

[75] Inventors: Yoichiro Ueno; Hiroshi Amatsu; Teruyuki Tashiro, all of Yokohama; Shingo Takamatsu, Akashi; Yukihito Morimoto, Machida, all of Japan

[73] Assignee: Mitsui O.S.K. Lines, Ltd., Tokyo, Japan

[21] Appl. No.: 920,877

[22] Filed: Jul. 28, 1992

[30] Foreign Application Priority Data

Jul. 29, 1991 [JP] Japan ..... 3-211548

[51] Int. Cl.[5] ..... A01G 31/00

[52] U.S. Cl. ..... 47/58; 47/60; 47/DIG. 6; 206/423

[58] Field of Search ..... 47/60 EC, 60 R, 17 EC, 47/DIG. 6, 58.23, 58.01; 206/423

[56] References Cited

U.S. PATENT DOCUMENTS

| | | | |
|---|---|---|---|
| 3,876,907 | 4/1975 | Widmayer | 47/DIG. 6 |
| 3,883,990 | 5/1975 | Stidolph | 206/423 |
| 4,015,366 | 4/1977 | Hall | 47/DIG. 6 |
| 4,400,910 | 8/1983 | Koudstaal | 47/84 |
| 4,910,032 | 3/1990 | Antoon | 47/84 |
| 5,012,609 | 5/1991 | Ignatius | 47/DIG. 6 |
| 5,022,181 | 6/1991 | Longstaff | 47/31 |

FOREIGN PATENT DOCUMENTS

| | | |
|---|---|---|
| 271074 | 3/1990 | Japan . |
| 271077 | 3/1990 | Japan . |

*Primary Examiner*—Henry E. Raduazo

*Attorney, Agent, or Firm*—Birch, Stewart, Kolasch & Birch

[57] ABSTRACT

A method for storing horticultural plants and an apparatus therefor are disclosed. The method of the present invention comprises placing the live horticultural plants in a container for transportation, wherein the temperature and the humidity in the container are kept at conditions suited for the horticultural plants within the range of 10°-25° C. and 60-90% RH, volatile gas generated by the horticultural plants are removed, the air inside the container is circulated, and the horticultural plants are irradiated with a light mainly composed of red light and blue light. The apparatus of the present invention comprises a container for storing the horticultural plants; a temperature controller for controlling the temperature in the container; a humidity controller for controlling the humidity in the container; a volatile gas adsorber for adsorbing volatile gas in the container; a wind-blower for circulating air in the container; and a light irradiator for irradiating a light mainly composed of red light and blue light.

4 Claims, 8 Drawing Sheets

METHOD AND APPARATUS FOR STORING HORTICULTURAL PLANTS

BACKGROUND OF THE INVENTION

I. Field of the Invention

This invention relates to a method and apparatus for storing horticultural plants such as orchid. The method and apparatus of the present invention are especially suited for overseas transportation or truckage of the horticultural plants by placing the plants in a container, enhancing the growth and keeping the qualities of the plants, thereby assuring the proper qualities of the plants after taking the plants out of the container.

II. Description of the Related Art

For the transportation of vegetables, fruits and horticultural plants, it is important for keeping the freshness of the products. As for vegetables and fruits, methods for transporting and storing the products for a considerably long time keeping the freshness of the products have been developed (Japanese Laid-open Patent Application (Kokai) Nos. 2-71074 and 2-71077). These methods include controlling of temperature and humidity and circulating air in the container by generating breeze.

Although the conventional methods are almost satisfactory from the practical viewpoint for transporting or storing vegetables and fruits, only unsatisfactory results are obtained even if the conventional methods are applied to the storage of flowers such as orchid. Due to the lack of an effective method for storing or transporting flowers such as orchid, by which the freshness of the flowers is kept, the foreign trade of the flowers is not so common in spite of the considerable demand for flowers with roots and cut flowers. Thus, means for storing or transporting horticultural plants keeping their freshness is demanded.

SUMMARY OF THE INVENTION

Accordingly, an object of the present invention is to provide a method for storing live horticultural plants, by which the qualities of the plants are kept for extended time period or by which the growth of the plants is attained.

Another object of the present invention is to provide an apparatus for carrying out the above-mentioned method of the present invention.

That is, the present invention provides a method for storing live horticultural plants comprising placing the live horticultural plants in a container for transportation, wherein the temperature and the humidity in the container are kept at conditions suited for the horticultural plants within the range of 10°–25° C. and 60–90% RH, volatile gas generated by the horticultural plants is removed, the air inside the container is circulated, and the horticultural plants are irradiated with a light mainly composed of red light and blue light.

The present invention also provides an apparatus for storing horticultural plants comprising a container for storing said horticultural plants; means for controlling the temperature in said container; means for controlling the humidity in said container; means for adsorbing volatile gas in said container; means for circulating air in said container; and means for irradiating a light mainly composed of red light and blue light.

By the method of the present invention, the qualities of horticultural plants are kept and/or the growth of the plants is attained when the horticultural plants are stored for a long time in a container for overseas transportation or truckage or for just storage. By the present invention, an apparatus by which the method of the present invention can be carried out was first provided.

DETAILED DESCRIPTION OF THE PREFERRED EMBODIMENTS

Figure 1:
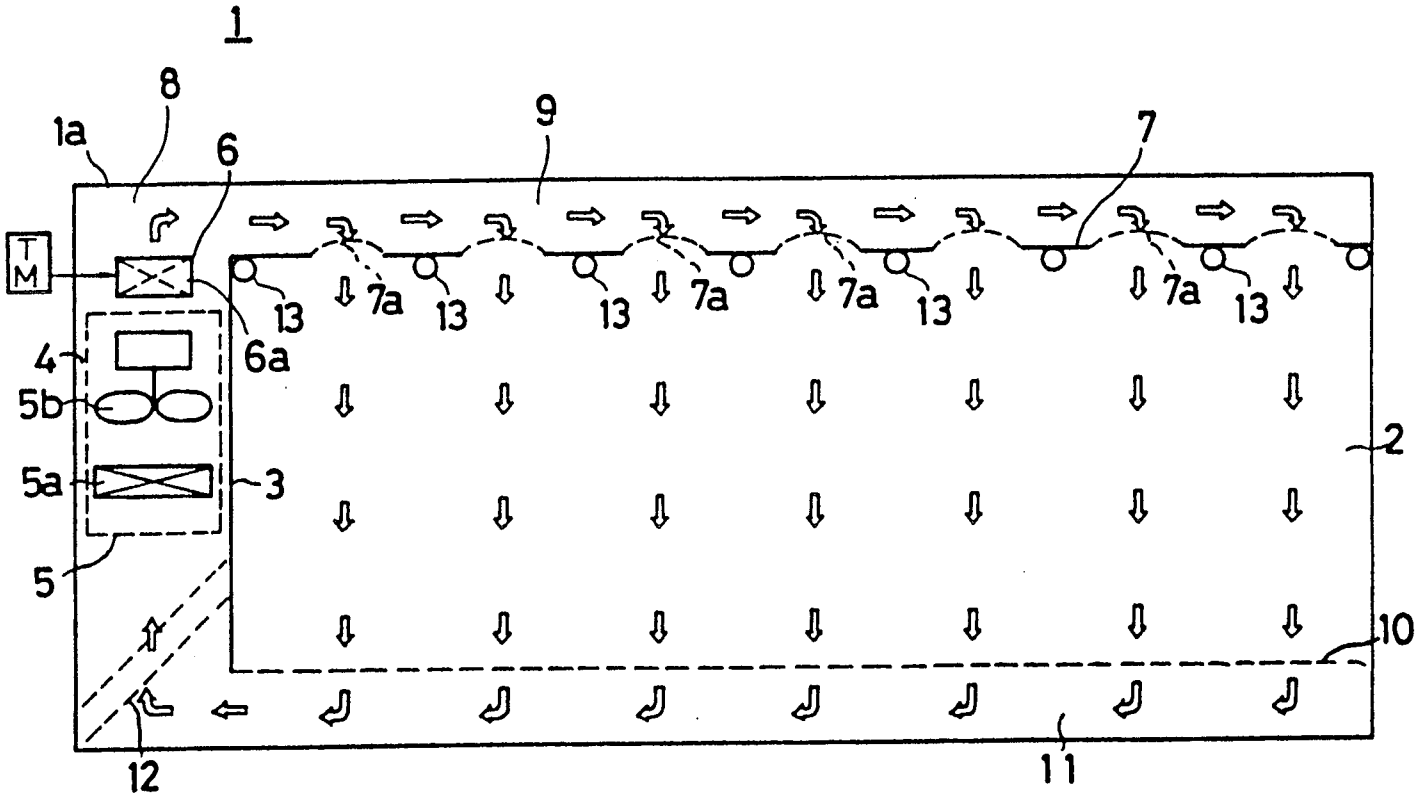
FIG. 1 is a schematic view showing a preferred embodiment of the apparatus for storing horticultural plants according to the present invention.

The horticultural plants to which the method of the present invention may be applied are not restricted. The method of the present invention is especially suited for the storage of flowers having roots or cut flowers such as orchid (that is, plants belonging to the family Orchidaceae).

The method of the present invention is applied to the storage of live plants. The term "live" herein means that the plant carries out a life reaction such as respiration or photosynthesis. It is well-known that the plants may be live even if they are cut. Therefore, cut flowers may also be subjected to the method of the present invention.

The live horticultural plants are stored in a container. Any container may be employed as long as the method of the present invention may be carried out. For example, the container may be a container widely used for overseas transportation or truckage, which sizes about 8×8×20 inches or about 8×8×40 inches, although the container is not restricted thereto.

In the container, the temperature and the humidity are kept at conditions suited for the horticultural plants stored within the ranges of 10°–25° C. and 60–90% RH. The optimal conditions may be easily selected depending on the plants to be stored. For example, in cases where orchid is stored, a temperature of about 16° C. and a humidity of about 75% are best preferred. By controlling the temperature within the range of 10°-25° C., promotion of the flowering and control of flowering may be attained. By keeping the humidity at 60-90% RH, the drying of the plants by evaporation of water from the plants may effectively be prevented.

During the storage, volatile gas such as ethylene and plant maturation hormones generated by the live horticultural plants stored is removed. This may be attained by, for example, circulating the air in the container through a filter which adsorbs volatile gas, as described later in more detail.

The air in the container is circulated by generating breeze. The velocity of the circulating air may preferably be 0.4-0.8 m/s. By circulating the air, the toxic volatile gases released from the plants are rapidly removed from the surface of the plants and the plants can always contact fresh air.

The plants stored in the container are irradiated with a light mainly composed of red light and blue light. The term "red light" means a light having a wavelength of 400-550 nm as well as a mixture thereof. The term "blue light" means a light having a wavelength of 550-700 nm as well as a mixture thereof. The term "mainly composed of" means that the percentage of the sum of the illumination intensity of the red light and blue light to the total illumination intensity is not less than 50%. The percentage of the sum of the illumination intensity of the red light and blue light to the total illumination intensity may preferably be not less than 70%, more preferably not less than 90%, and most preferably about 100%. By irradiating the plants with a light mainly composed of red light and blue light, the photosynthesis of the plants is effectively carried out. Further, although both the red light and blue light stimulate the growth of the plants, the red light inhibits the branching of the plants while the blue light promotes the branching of the plants. To attain well-balanced growth of the plants, it was found that a mixing ratio of the red light to the blue light in the light irradiated to the plants of 1:1 to 3:1, especially about 2:1 is preferred. By employing the light having the mixing ratio of red light to blue light within this range, effective and well-balanced growth of the plants may be attained.

The illumination intensity of the light to be irradiated to the plants is not critical and may be, for example, 500-2000 lux. The photoperiod may be selected as desired depending on the nature of the plants and/or on the desired control of the timing of flowering of the plants. More particularly, short-day plants may be illuminated according to the short-day regimen (e.g., 8 hours' illumination per day) and long-day plants may be illuminated according to the long-day regimen (e.g., 16 hours' illumination per day). Alternatively, it is well-known that the timing of flowering of plants, especially short-day plants, may be delayed or advanced by controlling the photoperiod. Therefore, the photoperiod may be controlled so as to attain the desired timing of the flowering. The turning on and off of the light source may preferably be carried out by employing a timer so that the natural conditions may be closely mimicked.

It is preferred to uniformly illuminate the plants. The output power of the light sources may preferably be determined by measuring the illumination intensity on the floor of the container after arranging the light sources. It is preferred to arrange the light sources so that the floor is illuminated uniformly without forming shade portions. In cases where the plants are placed in stacked state by using a rack, it may be preferred to arrange the light sources not only on the ceiling but also on the side walls of the container so as to attain the uniform illumination.

The method of storing the horticultural plants may be combined with other conventional methods for keeping freshness of agricultural products.

By the combination of the above-described conditions, the deterioration of the qualities of the plants may be effectively prevented and the desired growth of the plants may be attained, in the limited space in the container for transportation.

A preferred embodiment of the apparatus for carrying out the method of the present invention will now be described referring to the drawings.

FIG. 1 shows an example of the apparatus for storing horticultural plants according to the present invention. A container 1 includes a box-shaped container body 1*a*. In the container body 1*a*, a large storing room 2 for harboring the plants, which occupies the major part of the container body 1*a*, is formed. In the end portion of the container body 1*a*, opposite to the side having a door (not shown), a cooling unit chamber 4 separated from the storing room 2 by a partition 3 is formed. In the cooling unit chamber 4, a cooling unit 5 serving as a temperature controlling means and a wind-blowing means, as well as a humidifier 6 serving as a humidity-controlling means are arranged. By this arrangement, humidified and cooled air can be supplied.

A supply passage 9, which guides the humidified and cooled air supplied from the cooling unit chamber 4 through a cooling passage 8, is formed between a ceiling plate 7 of the storing room 2 and the upper end of the container body 1*a*. In the ceiling plate 7, a large number of spouting holes 7*a*, 7*a*, . . . are formed, through which the humidified and cooled air guided to the supply passage 9 is supplied to the storing room 2.

An air passage 11 is formed under the floor 10 of the storing room 2 by using a T-shaped rail. The air in the storing room 2 is circulated to the cooling unit chamber 4 via holes formed in the floor 10, the air passage 11 and via holes formed in the under side of the cooling unit chamber 4.

In the lower portion of the cooling unit 4, a volatile gas-adsorbing filter 12 serving as a volatile gas-adsorbing means, which adsorbs volatile gas such as ethylene, is arranged. When the air passes through the volatile gas-adsorbing filter, most part of the toxic volatile gases such as plant maturation hormones and ethylene, which are generated by the horticultural plants and diffused from the plants are adsorbed and removed from the air in the container 1.

With the construction mentioned above, as shown by the arrows in FIG. 1, a mixture of cooled air and mist (i.e., humidified and cooled air) generated by the cooling unit 5 and the humidifier 6 in the cooling unit chamber 4 is guided through the supply passage 9 and supplied to the storing room 2 containing the horticultural plants such as orchid via the supply holes 7*a*, thereby the qualities of the plants are kept. The air containing volatile gases generated by the horticultural plants is circulated to the cooling unit chamber 4 through the air passage 11 under the floor 10 and through the volatile gas-adsorbing filter 12 by which the volatile gases such as ethylene are adsorbed.

On the under side of the ceiling plate 7, an appropriate number of light sources 13 constituting a part of the light-irradiating means for irradiating red light and blue light are arranged. In cases where the horticultural plants are stacked in two or more layers using a rack, it may be preferred to arrange light sources 13 not only on the ceiling but also on the side walls so that the horticultural plants are uniformly illuminated.

In the preferred embodiment, the cross sectional area of the supply passage 9 is about ⅓ of that of the cooling passage 8 above the cooling unit chamber 4, which serves as an outlet of the cooled air and mist. With this constitution, the velocity of the humidified and cooled air from the cooling unit 4 is increased and the pressure thereof is decreased. To uniformize the temperature and humidity in the storing room 2, the diameters of the supply holes close to the cooling unit chamber 4 are made small and the diameters of the supply holes are made larger with the distance from the cooling unit chamber 4. With this structure, breeze with a uniform velocity of 0.4–0.8 m/s may be blown down from the supply holes 7a into the storing room 2, so that the temperature of any portion in the storing room 4 may be kept within a range of ±0.5° C.

The cooling unit 5 may be a conventional one having an evaporator 5a and a wind fan 5b. The air aspirated from the lower portion of the cooling unit 4 is cooled by the evaporator 5a and the cooled air is transferred to the supply passage 9 through the cooling passage 8 by the wind fan 5b. The cooled air is then supplied to the storing room 2 via the supply holes 7a formed in the ceiling plate 7.

The humidifier 6 includes an ultrasonic humidifier body 6a arranged adjacent to the cooling unit 5 as its major part. The inner structure of the humidifier body 6a may be a conventional one. That is, in the humidifier body 6a, mist is formed by ultrasonication of water pooled in a bath using an oscillator, and the formed mist is jetted from a nozzle. Air inlets for introducing air into the cooling chamber 4 are formed at a downstream portion of the wind fan 5b and in the vicinity of the wind fan 5b. On the other hand, the jet nozzle of the humidifier 6 is arranged at the entrance portion of the supply passage 9, that is, at the boundary of the cooling passage 8 and the supply passage 9.

The humidifier 6 includes a timer means TM which sends a signal for driving the humidifier in a prescribed time interval for a prescribed time period. By the timer means TM, the ultrasonic humidifier may be, for example, driven for 5 minutes and then stopped for 5 minutes. The driving time and the stopping time set by the timer are controllable, so that the humidity in the storing room 2 may be desirably controlled. In a preferred embodiment, by virtue of the timer means, the humidity in the storing room may be kept at 85–95% RH at 0°–+10° C.

Figure 2:
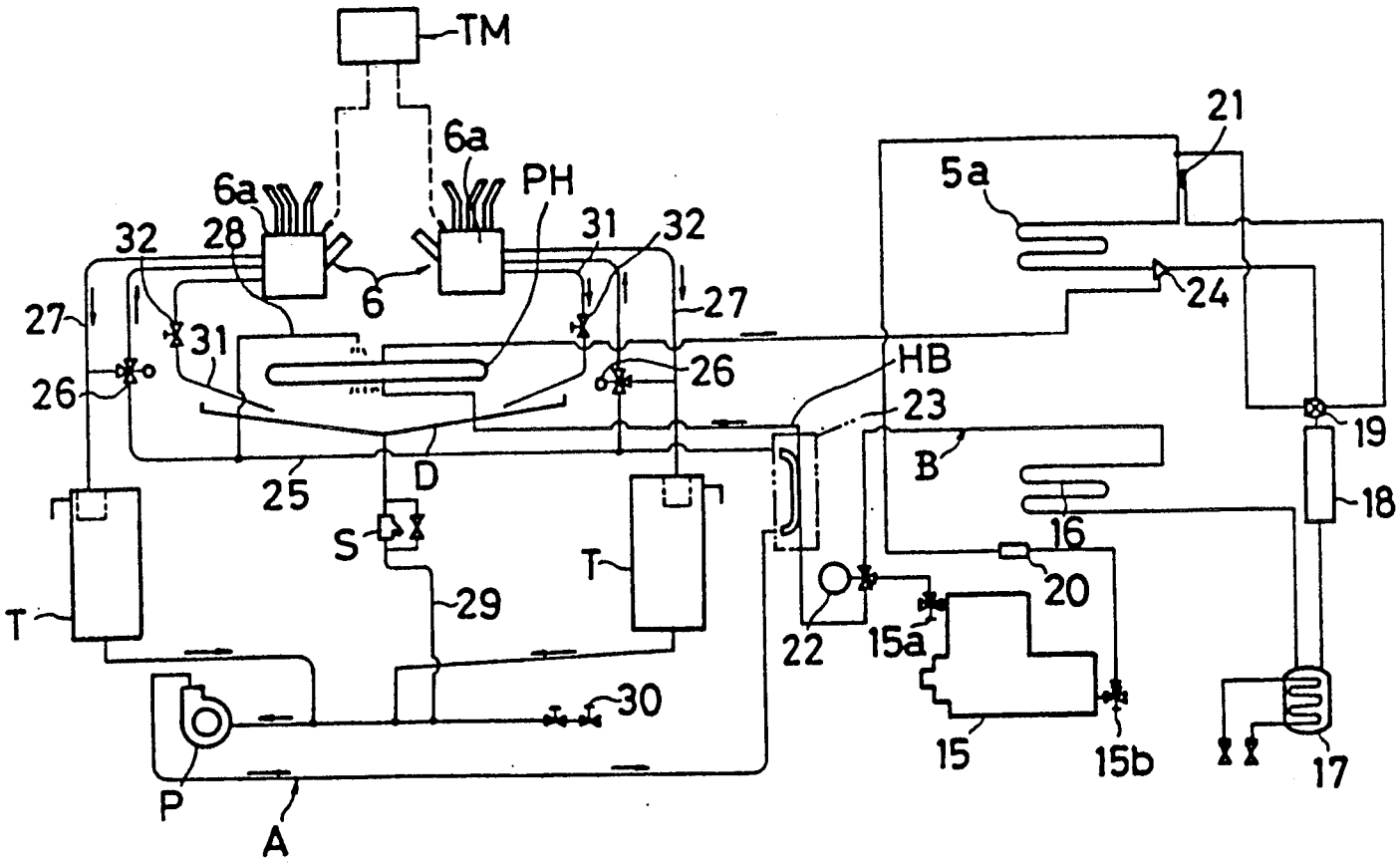
FIG. 2 shows a water supply circuit of the humidifier and a circuit of the cooling unit which are employed in a preferred embodiment of the apparatus for storing horticultural plants according to the present invention.

The cooling unit 5 and the humidifier 6 will now be described referring to FIG. 2 showing an example of the circuits thereof.

The circuit of the coolant of the cooling unit 5 includes via a joint 15a, in the order mentioned from the discharging side of a compressor 15, an air-cooled condenser 16, a water-cooled condenser 17, accessories 18 such as accumulator, expansion valve 19 and the evaporator 5a. The evaporator 5a is connected to the aspiration side of the compressor 15 via a flexible pipe 20. The high pressure coolant compressed by the compressor 15 is condensed by the both condensers 16 and 17 and evaporated by the evaporator 5a. The evaporated coolant returns to the compressor 15. At the evaporator 5a, the evaporated coolant exchanges the heat with the air in the cooling passage 8 so as to cool the air. The expansion valve 19 is controlled by the temperature measured by a thermistor 21 provided on the outlet side of the evaporator 5a and by the pressure of the coolant.

A three-way proportional valve 22 is provided between the compressor 15 and the air-cooled condenser 16. One end of a hot gas bypass HB is connected to the three-way proportional valve. A heat exchanger 23 for supplied water and a drain pan heater PH are connected through the hot gas bypass HB. The other end of the hot gas bypass is connected to the aspiration side of the evaporator 5a through a shunt 24. The hot gas bypass HB is constituted such that the volume of the coolant circuit is controlled by the amount of the supplied hot gas.

The three-way proportional valve 22 is constituted such that its divergence is proportionally controlled by the PID control by measuring the temperature of the air spouted from the evaporator 5a. More particularly, when the temperature of the air from the evaporator 5a is higher than the upper limit of a prescribed temperature range, that is, for example, in the pulled down state, the entire hot gas is transferred to the air-cooled condenser 16, and when the temperature of the air from the evaporator 5a is lowered, for example, to 0° C., the hot gas is transferred to the hot gas bypass HB. The amount of the hot gas supplied to the hot gas bypass is proportionally controlled by the temperature of the air spouted by the evaporator 5a. On the other hand, when the temperature of the air spouted by the evaporator 5a is lower than the lower limit of the prescribed temperature range, the circuit acts in the heating mode and the entire hot gas is supplied to the hot gas bypass HB.

The temperature in the storing room 2 may be controlled to −25° C.–+25° C. By controlling the velocity of the wind (circulating air) within the range of 0.4–0.8 m/s, by employing the supply passage 9 and the supply holes 7a so as to uniformly blow down the air, and by controlling the entire system by a computer, the temperature in the storing room 2 may be controlled within a range of ±0.5° C. By providing a damper (not shown) in the supply passage 9, the raise of the temperature of the air in the storing room during defrosting may be prevented.

The humidifier 6 has two humidifier bodies 6a arranged at both sides thereof and a water supply circuit A serving as a water supplying means is connected thereto. In the water supply circuit, the discharging side of the water supply pump P is connected to the humidifier body 6a through a water supply duct 25 via a three-way electromagnetic valve 26. Further, an over flow duct 27 connected to the humidifier body 6a is connected to the suction side of the water supply pump P via a water tank T. The three-way electromagnetic valve 26 appropriately bypasses the water supply duct 25 and the over flow duct 27.

The water supply to the humidifier body 6a is constituted as an over flow system. That is, the water supplied to the humidifier body 6a for generating mist is always circulated through the pump P, water supply duct 25, humidifier body 6a and the over flow duct 27 in the order mentioned. The midway of the water supply duct 25 is connected to the heat exchanger 23 for supplied water. In the heat exchanger 23, heat is exchanged between the water to be supplied to the humidifier body 6a and the hot gas of the coolant, so that the water to be supplied to the humidifier body 6a is heated. Still further, from a portion of the water supply duct 25 downstream the heat exchanger 23, a branch duct 28 is branched.

Beneath the evaporator 5a, a drain pan D for collecting the drain generated during defrosting is provided, and a drain duct 29 is connected to the drain pan D. The drain duct 29 is introduced to the outside of the container 1 via a strainer S. A valve 30 is provided at the outer end of the drain duct 29. The valve 30 may be opened during the time other than during the cooling of the system, so that the water in the water supply duct may be discarded. The drain pan D is provided with a drain pan heater PH and the branch duct 28 is connected to the drain pan via the drain pan heater PH. To the drain pan D, a part of the water supplied to the humidifier body 6a is always supplied from the branch duct 28, so that the drain pan heater PH heats the water supplied from the branch duct 28 and the drain of the evaporator 5a. The amount of the heat given to the water by the heat exchanger 23 for supplied water and by the drain pan heater PH is controlled by the amount of the hot gas supplied to the hot gas bypass HB by the three-way proportional valve 22. A water duct 31 connected to the humidifier body 6a has a valve 32 and is connected to a drain pan D.

Figure 3:
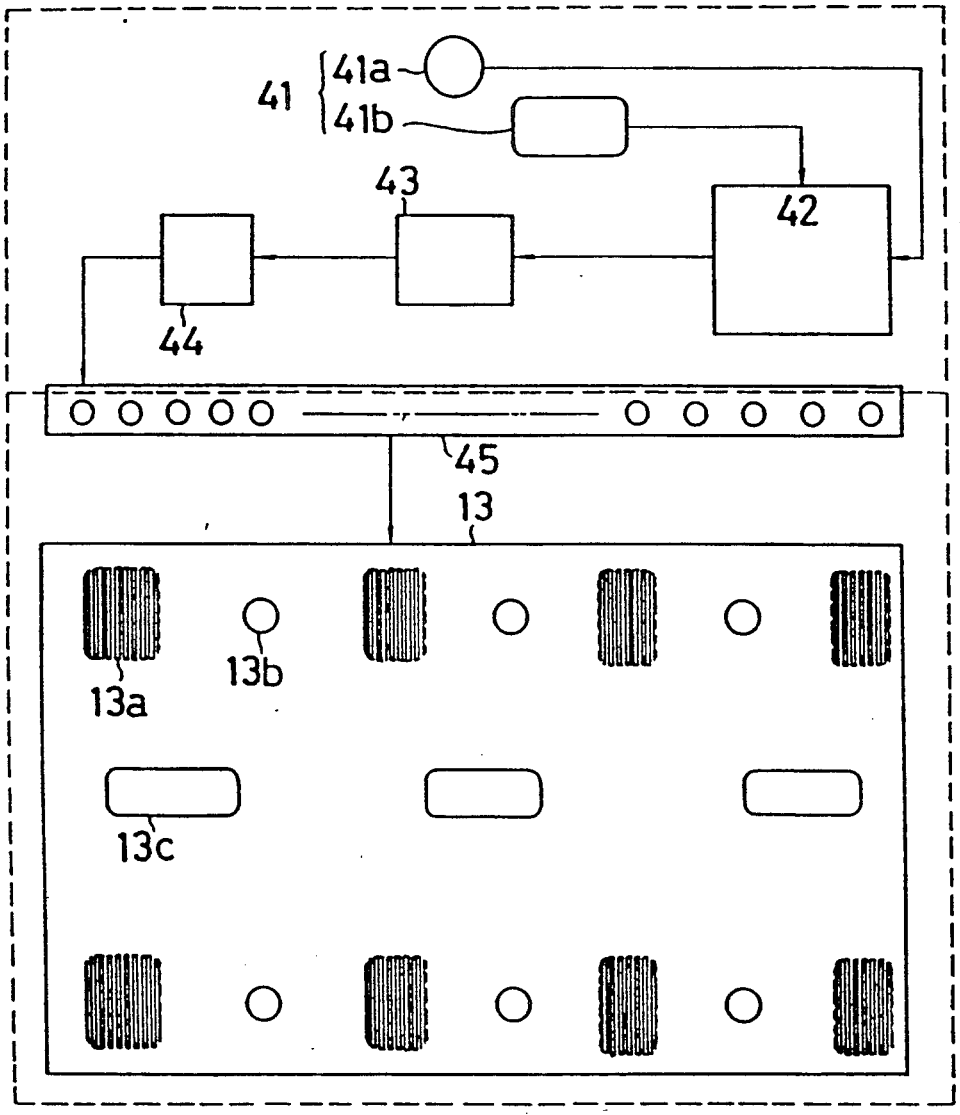
FIG. 3 is a schematic view for explaining a light-irradiation means employed in a preferred embodiment of the apparatus for storing horticultural plants according to the present invention.

The light-irradiating means is means for irradiating the light suited for the physiology intrinsic to the horticultural plants stored. The details of the light-irradiating means are shown in FIG. 3. The light-irradiating means comprises an electric power-supplying section 41 including an external electric power-connecting section 41a, an internal electric power section 41b and the like, an electric power-controlling section 42, an illumination time-controlling section 43, an illumination intensity-controlling section 44, a light source-detaching and attaching section 45 and light-irradiating section 13 including light sources. The external electric power-connecting section 41a is a connecting section for receiving electric power from a transportation means such as ship or truck. In cases where external electric power is not available, the apparatus can generate power by itself by the internal electric power section 41b.

The electric power-controlling section 42 receives electric power from the external electric power-connecting section 41a or the internal electric power section 41b, and transfers the electric power to the illumination time-controlling section 43 and the illumination intensity-controlling means 44 after converting the electric power to an appropriate form. The electric power-controlling section 42 also restricts the power capacity, cuts the power and controls the automatic switching from the external power source to the internal power source and vice versa.

The illumination time-controlling section 43 controls the illumination time so that the photoperiod matching the photoperiodism intrinsic to the plants stored is attained. The illumination intensity is controlled by the illumination intensity-controlling section 44.

To connect the light sources of the light-irradiating section 13 and the illumination intensity-controlling section 44, light source-detaching and attaching section 45 is provided in the container in portions suitable for the particular manner of storage. The light-irradiating section 13 includes light sources which emits a light effective for keeping the qualities, promote the growth and/or control the growth or flowering, and/or for sterilization, such as red fluorescent lamp 13a, blue incandescent electric lamp 13b or blue fluorescent lamp 13c.

In operation, live horticultural plants are placed in the storing room 2. In the storing room 2, the temperature is kept at 10°-25° C., and the humidity is kept at 60-90% RH by utilizing the above-described means for controlling the temperature and humidity. The toxic volatile gases such as plant maturation hormones and ethylene generated by the plants and diffused therefrom are adsorbed by the volatile gas-adsorbing filter 12, and the air inside the container is circulated by generating breeze by the wind fan 5b. The plants in the storing room 2 are irradiated with a light mainly composed of red and blue light by the light-irradiation section 13 in the light-irradiation means. In the preferred embodiment, the illumination intensity of the red light to the blue light is about 2:1, thereby the outer appearance of the horticultural plants such as orchid is well-balanced, the growth of the plants is promoted and the qualities of the plants are kept.

The invention will now be described by way of experimental examples. It should be noted that the examples are presented for the illustration purpose only and should not be interpreted in any restrictive way.

Figure 4:
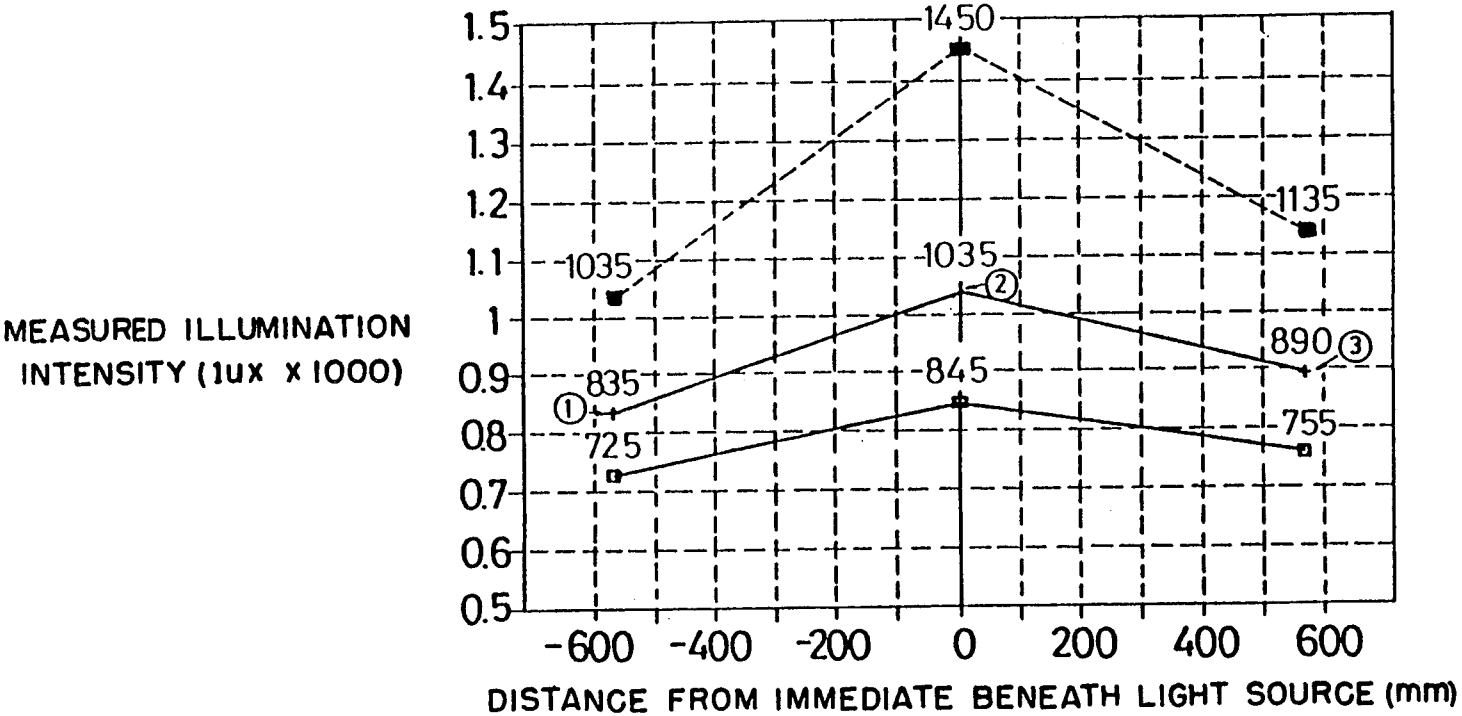
FIG. 4 shows the measured illumination intensities in a storing room employed in the experiments.

In the following examples, the experiments were carried out employing the illumination intensities shown in FIG. 4. More particularly, FIG. 4 shows the illumination intensity at each portion in the storing room. The distance from the location immediate beneath a light source (i.e., location ②) is taken along the abscissa and the illumination intensity (lux) at each portion is taken along the ordinate. In FIG. 4, the symbol "□" indicates the illumination intensity on the floor, the symbol "+" indicates the illumination intensity at a location having a height of 300 mm from the floor, and the symbol "  " indicates the illumination intensity at a location having a height of 600 mm from the floor. The illumination intensity was adjusted measuring the illumination intensity at the location immediate beneath the light source (i.e., location ②) at a height of 300 mm from the floor. Although the illumination intensities at the locations ① and ③ are lower than at the location ②, no significant difference was observed in the influences given to the plants at each location.

EXPERIMENT 1

Experiment of Long-term Transportation of Orchid (Dendrobium/Phalaenopsis)

The plants used in the experiment were the same variety of orchid (Dendrobium/Phalaenopsis) harvested from the same field. Each plant had roots and planted in a pot with a diameter of about 6 cm. Each plant had five flowers and five buds.

The plants were grouped into Group A, Group B and Group C. The conditions employed for each group are shown in Table 1. As shown in Table 1, the plants of Group A were stored in a room at room temperature (20° C.) under natural conditions. The plants of Groups B and C were stored in the apparatuses according to the present invention described above referring to FIGS. 1-3, which employ containers for overseas transportation. As shown in Table 1, the conditions of Groups B and C were exactly the same except that the plants of Group C were illuminated while the plants of Group B were not. The plants of Group C were illuminated for 10 hours a day. The illumination intensity was as shown in FIG. 4 by the symbol "+".

The time from the loading of the plants to the unloading of the plants was 20 days, which simulates the overseas transportation. This time period is hereinafter referred to as "experiment period". After unloading the plants from the container, the plants were stored in a room at 20° C. under natural conditions. Up to 40 days after unloading the plants (i.e., up to 60 days from the beginning of the experiment), the states of the plants were observed so as to evaluate the duration in which the plants kept their commercial values. This time period is hereinafter referred to as "evaluation period" for short.

Figure 5:
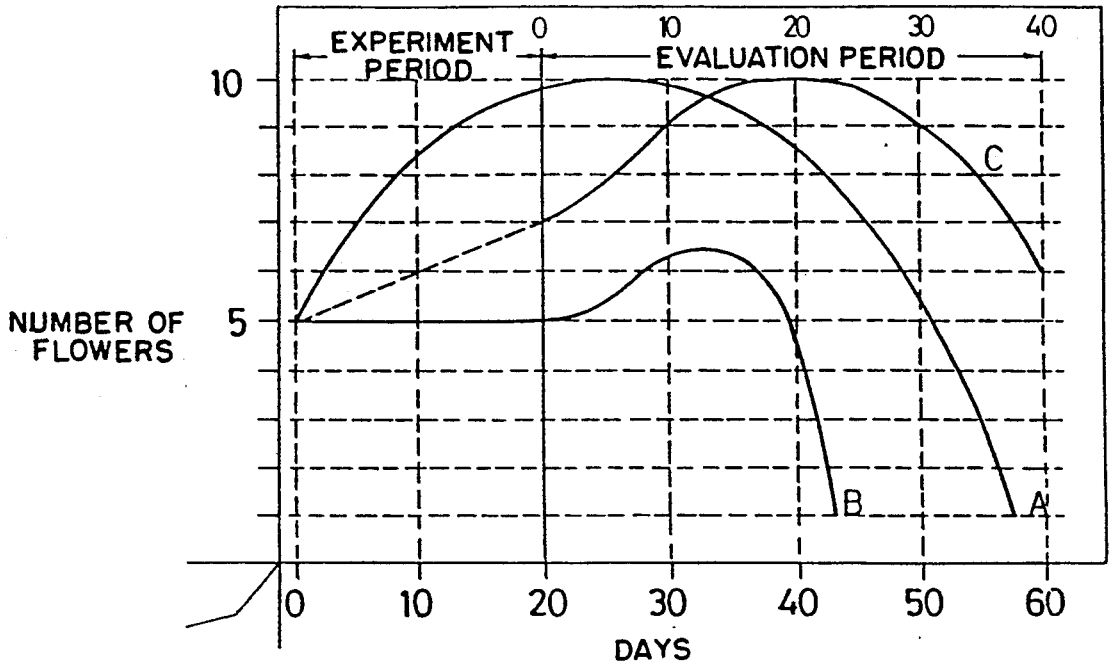
FIG. 5 shows the results of the long-term transportation of orchid (Dendrobium/Phalaenopsis), which was carried out under conditions shown in Table 1.

The results are shown in FIG. 5. As shown in FIG. 5, the plants of Group A reached to full blossom 20 days after the beginning of the experiment, so that each of the buds flowered every 3.5 days on the average. The plants of Group A maintained their commercial values for 24 days from the beginning of the evaluation period.

As for the plants of Group B, although significant change in outer appearance was not observed for the five flowers during the storage in the container, the growth of buds stopped, the green of the whole plants was faded and some buds turned yellow and dropped. Thus, the plants did not reach to the normal flowering during the evaluation period and their commercial values were rapidly lost.

As for the plants of Group C which were treated according to the present invention, one bud completely flowered and one bud incompletely flowered during the storage in the container, so that growth of the plants were attained during the storage in the container, even though the growth is slower than the plants of Group A cultivated under natural conditions in a room. In FIG. 5, the number of flowers during the storage in the container is indicated by a broken line because the inside of the container cannot be observed during the experiment period. No bud fell or turned yellow during the storage. During the evaluation period, the plants normally flowered to reach to full blossom. When the results of Group C are compared with the results of Group A, the commercial values of the plants of Group C were maintained 9 days longer than the plants of Group A on the average. Thus, a substantial photoeffect was observed.

The results of this example show the effect of the minimum illumination intensity which was selected for keeping the qualities and inhibiting the growth during the transportation. By increasing the illumination intensity and/or by changing the temperature, the flowering may be accelerated or delayed.

EXPERIMENT 2

The same experiment as in Experiment 1 was repeated except that the variety of the used orchid was Phalaenopsis and the conditions during the storage were as shown in Table 2.

Figure 6:
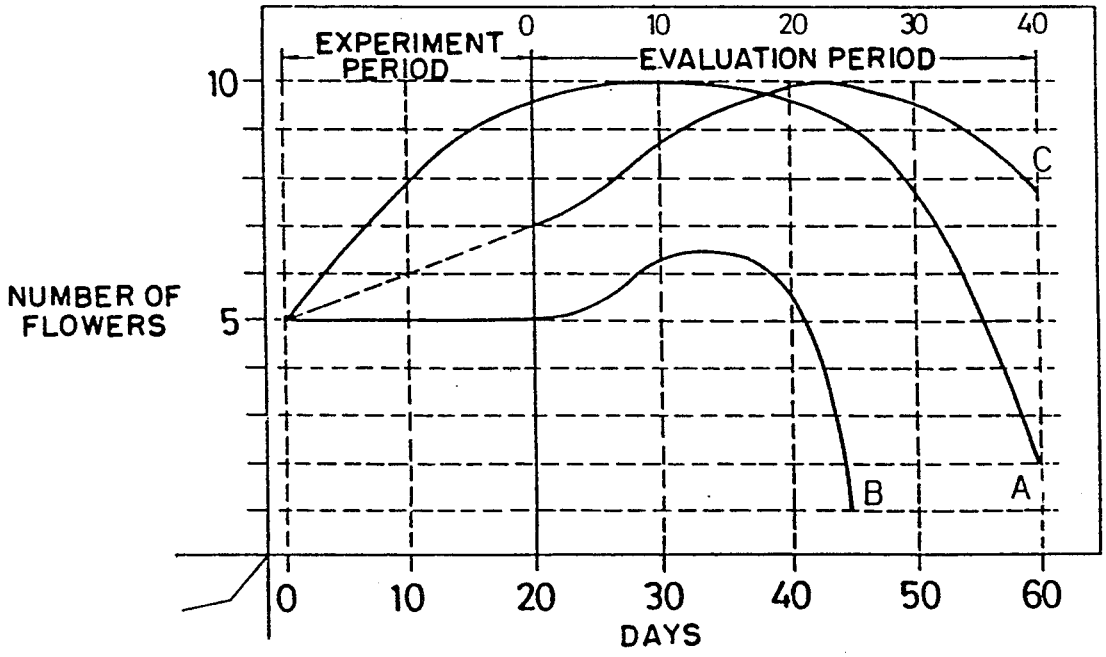
FIG. 6 shows the results of the long-term transportation of orchid (Phalaenopsis), which was carried out under conditions shown in Table 2.

The results are shown in FIG. 6. As shown in FIG. 6, the plants of Group A reached to full blossom 20 days after the beginning of the experiment, so that each of the buds flowered every 3.5 days on the average. The plants of Group A maintained their commercial values for 30 days from the beginning of the evaluation period.

As for the plants of Group B, although significant change in outer appearance was not observed for the five flowers during the storage in the container, the green of the whole plants was faded and some portions turned yellow. The growth of the buds stopped and some of the buds on the middle part of the plants dropped. Thus, the plants did not reach to the normal flowering during the evaluation period and their commercial values were rapidly lost.

As for the plants of Group C which were treated according to the present invention, one bud completely flowered and one bud incompletely flowered during the storage in the container, so that growth of the plants were attained during the storage in the container, even though the growth is slower than the plants of Group A cultivated under natural conditions in a room. No bud dropped or turned yellow during the storage. During the evaluation period, the plants normally flowered to reach to full blossom. When the results of Group C are compared with the results of Group A, the commercial values of the plants of Group C were maintained 10 days longer than the plants of Group A on the average. Thus, a substantial photoeffect was observed.

The results of this example show the effect of the minimum illumination intensity which was selected for keeping the qualities and inhibiting the growth during the transportation. By increasing the illumination intensity and/or by changing the temperature, the flowering may be accelerated or delayed.

EXPERIMENT 3

The same experiment as in Experiment 2 was repeated except that the conditions during the storage were as shown in Table 3.

Figure 7:
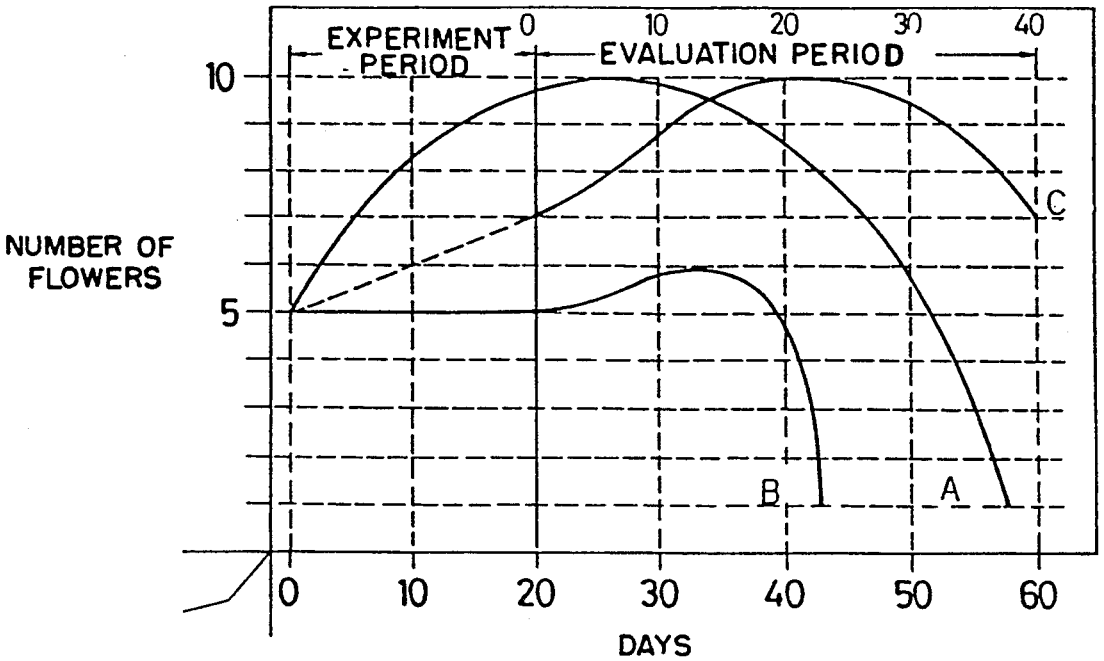
FIG. 7 shows the results of the long-term transportation of orchid (Phalaenopsis), which was carried out under conditions shown in Table 3.

The results are shown in FIG. 7. As shown in FIG. 7, substantially the same results as in Experiment 2 were obtained.

EXPERIMENT 4

The same experiment as in Experiment 2 except that the conditions during storage were as shown in Table 4 and the plants of Group C were illuminated for 12 hours a day.

Figure 8:
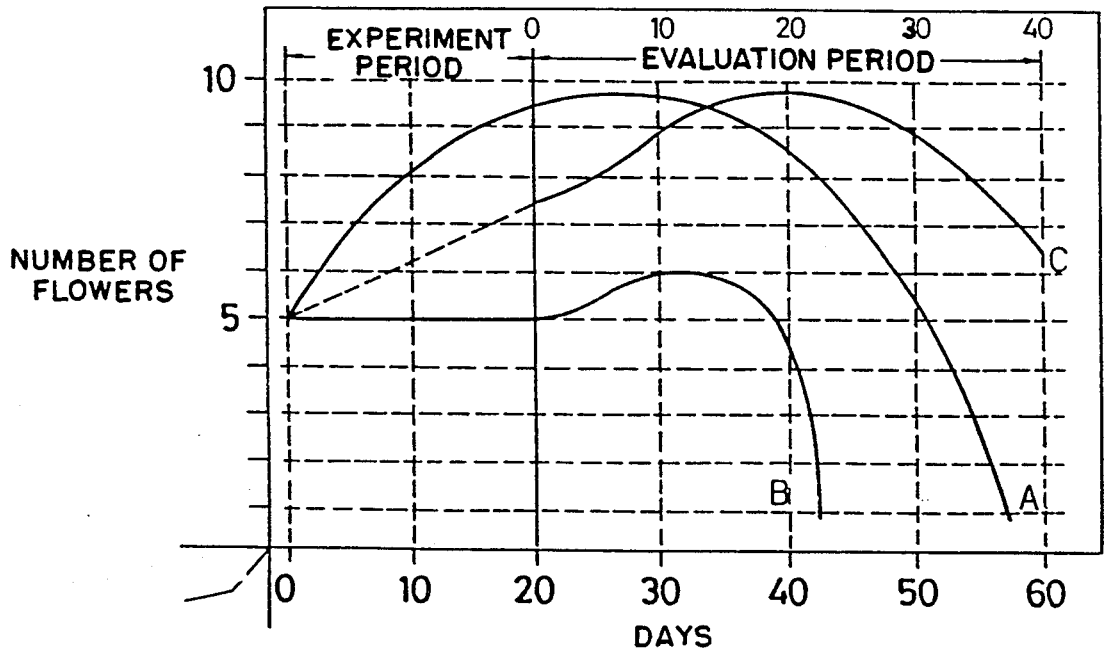
FIG. 8 shows the results of the long-term transportation of orchid (Phalaenopsis), which was carried out under conditions shown in Table 4.

The results are shown in FIG. 8. As shown in FIG. 7, substantially the same results as in Experiment 2 were obtained.

In the following Experiments 5–7, the similar experiments as in Experiments 1–4 were carried out. In Experiments 5–7, the conditions during the storage were selected by combining the maximum values (MAX) and minimum values (MIN) of the temperature and humidity within the ranges defined in the present invention shown in Table 5. The results were not good as will be described later, if the temperature is within the range of 10°–25° C. and the humidity is within the range of 60–90% RH, the acceptable results may be obtained by optimizing other conditions such as velocity of the breeze or the like. Thus, for example, even if the temperature is as high as 25° C., by optimizing the humidity, velocity of the breeze and the like so as to keep the entire balance, acceptable results may be obtained. By these experiments, it was confirmed that significant differences are resulted between the cases where the illumination of red and blue light was performed and the cases where illumination was not performed.

EXPERIMENT 5

The same experiment as in Experiment 1 was repeated except that the conditions during the storage were as shown in Table 6.

Figure 9:
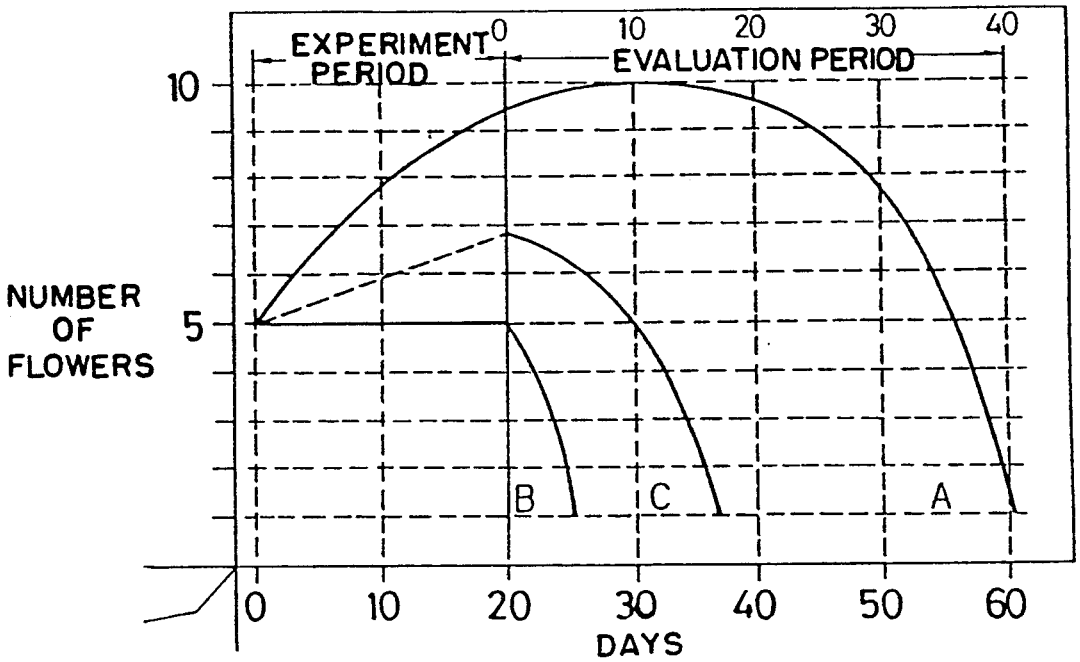
FIG. 9 shows the results of the long-term transportation of orchid (Phalaenopsis), which was carried out under conditions shown in Table 6.

The results are shown in FIG. 9. As shown in FIG. 9, the plants of Group A reached to full blossom 20 days after the beginning of the experiment, so that each of the buds flowered every 3.5 days on the average. The plants of Group A maintained their commercial values for 24 days from the beginning of the evaluation period.

As for Group B, the petals of the five flowers which each plant had before the experiment were stained. Some of the buds turned yellow and dropped. On some parts of the plants, blue mold was observed. Thus, at the end of the experiment period, the plants had lost their commercial values.

As for Group C, although two buds flowered during the experiment period, the petals of the flowers were stained and some buds on the middle part of the plants turned yellow and dropped. Thus, the plants had lost their commercial values. Although the growth of the plants was observed at a temperature as high as 25° C., the plants were deteriorated because the overall balance, especially the selection of the humidity and the velocity of wind, was not appropriate. The evaluation was stopped during the evaluation period.

EXPERIMENT 6

The same experiment as in Experiment 1 was repeated except that the conditions during the storage were as shown in Table 7.

Figure 10:
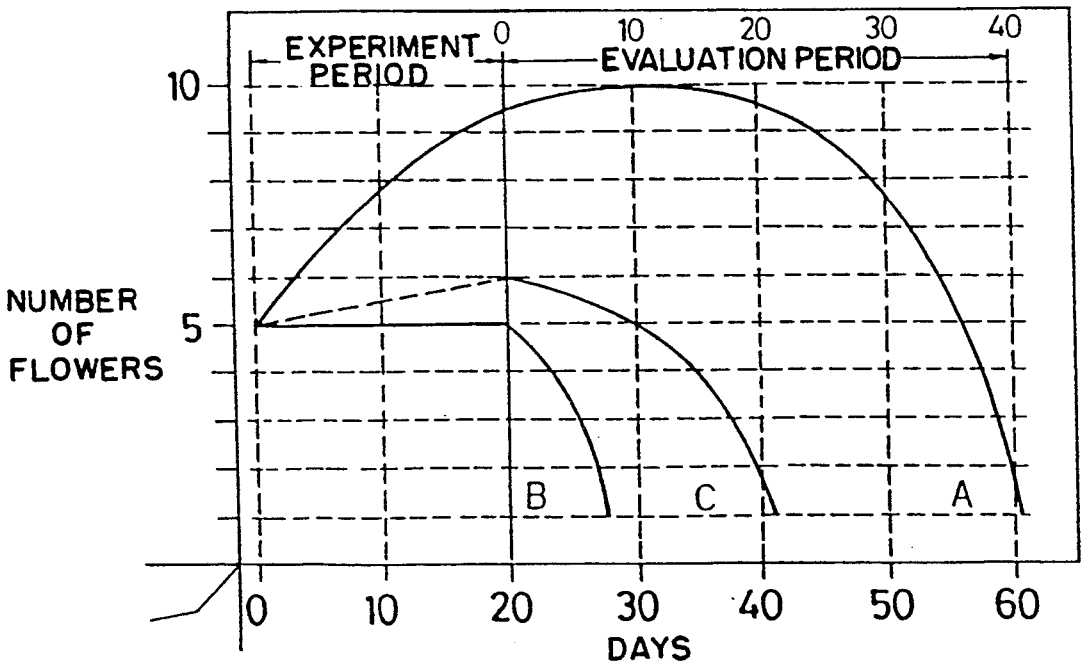
FIG. 10 shows the results of the long-term transportation of orchid (Phalaenopsis), which was carried out under conditions shown in Table 7.

The results are shown in FIG. 10. As shown in FIG. 9, the plants of Group A reached to full blossom 20 days after the beginning of the experiment, so that each of the buds flowered every 3.5 days on the average. The plants of Group A maintained their commercial values for 24 days from the beginning of the evaluation period.

As for Group B, on the petals of the five flowers which each plant had before the experiment, stains with diameters of about 1 mm were formed, although the number thereof is not so large. Further, the petals shrunk and deposition of anthocyanin and pelargonidin were observed on the backsides of the petals, so that the color of the flowers changed. The growth of the buds was stopped during the experiment period. Although color change was observed, some buds on the middle part of the plants dropped.

As for Group C, the petals of the five flowers which each plant had before the experiment were stained as in Group B. Although the buds grew slowly during the experiment period, some buds dropped during the evaluation period to lose their commercial values. It turned out that the deposition of anthocyanin and pelargonidin was due to the low temperature, so that the reconsideration of the overall conditions, mainly temperature conditions, is necessary.

EXPERIMENT 7

In view of the experimental results of Experiments 5 and 6, the conditions employed these experiments were combined. That is, the same experiment as in Experiment 1 was repeated except that the conditions during the storage were as shown in Table 8.

Figure 11:
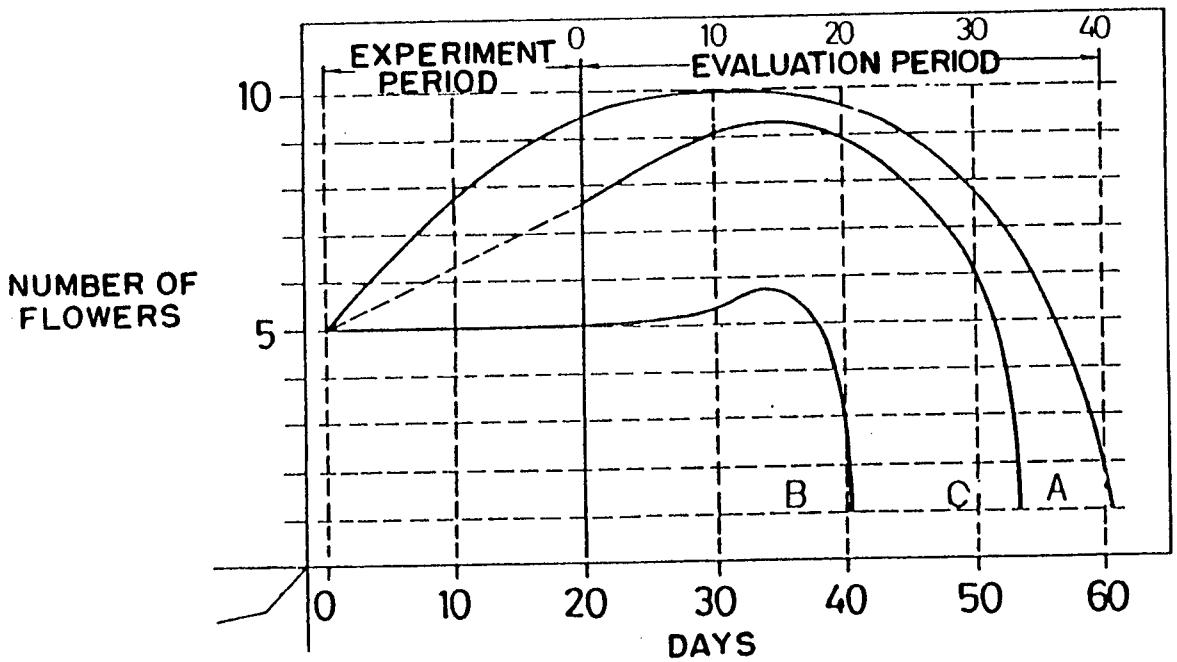
FIG. 11 shows the results of the long-term transportation of orchid (Phalaenopsis), which was carried out under conditions shown in Table 8.

The results are shown in FIG. 11. As shown in FIG. 11, the plants of Group A reached to full blossom 20 days after the beginning of the experiment, so that each of the buds flowered every 3.5 days on the average. The plants of Group A maintained their commercial values for 24 days from the beginning of the evaluation period.

As for Group B, although the petals of the five flowers which each of the plants had before experiment shrunk due to aging, no stains were formed on the petals. Some buds turned yellow and dropped during the evaluation period.

As for Group C, although the conditions were thought to be appropriate, the growth was accelerated and at the end of the experiment period, the flowers on the lower portion of the plants seemed to have passed their most beautiful period. The growth of the buds was considerably promoted and two buds flowered completely and one bud flowered incompletely during the experiment period.

In both the Groups B and C, since a relatively high temperature and a low humidity were employed, the plants accelerated the flowering in the container in order to prevent the drying of the plants, so that the enjoyable period begun in the container. Thus, it was confirmed that appropriate transportation may be attained by lowering the temperature, raising the humidity and decreasing the illumination intensity.

Although the invention was described by way of preferred embodiments thereof, it is apparent for those skilled in the art that various modifications may be made without departing from the spirit and scope of the present invention, and it is contemplated that such modifications are within the scope of the present invention.

TABLE 1

| | Temperature | Humidity | Volatile Gas Adsorption | Wind Velocity | Light Source |
|---|---|---|---|---|---|
| Group A | Control Group Employing Natural Conditions at 20° C. | | | | |
| Group B | 15° C. | 75% RH | Adsorb | 60 cm/sec. | None |
| Group C | 15° C. | 75% RH | Adsorb | 60 cm/sec. | Used |

TABLE 2

| | Temperature | Humidity | Volatile Gas Adsorption | Wind Velocity | Light Source |
|---|---|---|---|---|---|
| Group A | Control Group Employing Natural Conditions at 20° C. | | | | |
| Group B | 16° C. | 70% RH | Adsorb | 50 cm/sec. | None |
| Group C | 16° C. | 70% RH | Adsorb | 50 cm/sec. | Used |

TABLE 3

| | Temperature | Humidity | Volatile Gas Adsorption | Wind Velocity | Light Source |
|---|---|---|---|---|---|
| Group A | Control Group Employing Natural Conditions at 20° C. | | | | |
| Group B | 17° C. | 65% RH | Adsorb | 30 cm/sec. | None |
| Group C | 17° C. | 65% RH | Adsorb | 30 cm/sec. | Used 1000 Lux |

TABLE 4

| | Temperature | Humidity | Volatile Gas Adsorption | Wind Velocity | Light Source |
|---|---|---|---|---|---|
| Group A | Control Group Employing Natural Conditions at 20° C. | | | | |
| Group B | 18° C. | 70% RH | Adsorb | 30 cm/sec. | None |
| Group C | 18° C. | 70% RH | Adsorb | 30 cm/sec. | Used 800 Lux |

TABLE 5

| | Temperature | Humidity | Volatile Gas Adsorption | Wind Velocity | Light Source |
|---|---|---|---|---|---|
| MAX | 25° C. | 90% RH | 0.1 PPM | 70 cm/sec. | 1450 Lux |
| MIN | 10° C. | 60% RH | 0.01 PPM | 30 cm/sec. | 725 Lux |

TABLE 6

| | Temperature | Humidity | Volatile Gas Adsorption | Wind Velocity | Light Source |
|---|---|---|---|---|---|
| Group A | Control Group Employing Natural Conditions at 20° C. | | | | |
| Group B | 25° C. | 90% RH | 0.1 PPM | 70 cm/sec. | None |
| Group C | 25° C. | 90% RH | 0.1 PPM | 70 cm/sec. | Used 1450 Lux |

TABLE 7

| | Temperature | Humidity | Volatile Gas Adsorption | Wind Velocity | Light Source |
|---|---|---|---|---|---|
| Group A | Control Group Employing Natural Conditions at 20° C. | | | | |
| Group B | 10° C. | 60% RH | 0.01 PPM | 30 cm/sec. | None |
| Group C | 10° C. | 60% RH | 0.01 PPM | 30 cm/sec. | Used 725 Lux |

TABLE 8

| | Temperature | Humidity | Volatile Gas Adsorption | Wind Velocity | Light Source |
|---|---|---|---|---|---|
| Group A | Control Group Employing Natural Conditions at 20° C. | | | | |
| Group B | 25° C. | 60% RH | 0.1 PPM | 30 cm/sec. | None |
| Group C | 25° C. | 60% RH | 0.1 PPM | 30 cm/sec. | Used 1450 Lux |

We claim:

1. A method for storing live horticultural plants comprising placing said live horticultural plants in a container for transportation, wherein the temperature and the humidity in said container are kept at conditions suited for said horticultural plants within the range of 10°–25° C. and 60–90% RH, volatile gas generated by said horticultural plants is removed, the air inside said container is circulated, and said horticultural plants are irradiated with a light mainly composed of red light and blue light.

2. The method of claim 1, wherein the ratio of the illumination intensity of said red light to the illumination intensity of said blue light is about 2:1.

3. The method of claim 1, wherein said horticultural plants belong to family Orchidaceae.

4. An apparatus for storing horticultural plants comprising:

a container for storing said horticultural plants;

means for controlling the temperature in said container;

means for controlling the humidity in said container;

means for adsorbing volatile gas in said container;

means for circulating air in said container; and means for irradiating a light mainly composed of red light and blue light.

* * * * *